US008096690B2

(12) United States Patent
Goncalves et al.

(10) Patent No.: US 8,096,690 B2
(45) Date of Patent: Jan. 17, 2012

(54) LIGHT MODULE FOR SIGNALING

(75) Inventors: Whilk Goncalves, Paris (FR); Otavio-Henrique Reis, Osasco (FR)

(73) Assignee: Valeo Vision, Bobigny (FR)

( * ) Notice: Subject to any disclaimer, the term of this patent is extended or adjusted under 35 U.S.C. 154(b) by 408 days.

(21) Appl. No.: 12/014,377

(22) Filed: Jan. 15, 2008

(65) Prior Publication Data

US 2008/0175015 A1 Jul. 24, 2008

(30) Foreign Application Priority Data

Jan. 19, 2007 (FR) ..... 07 00388
May 29, 2007 (FR) ..... 07 03793

(51) Int. Cl.
*F21V 7/00* (2006.01)

(52) U.S. Cl. ..... 362/518; 362/297; 362/346

(58) Field of Classification Search ..... 362/16, 362/240, 247, 296.01, 296.09, 296.1, 297, 362/309, 310, 311.11, 327–329, 332, 336–338, 362/341, 346–348, 350, 516–518, 522, 538, 362/539; 359/618–633

See application file for complete search history.

(56) References Cited

U.S. PATENT DOCUMENTS 4,035,631 A * 7/1977 Day, Jr. ..... 362/297
4,153,929 A * 5/1979 Laudenschlarger et al. .. 362/348
4,704,661 A * 11/1987 Kosmatka ..... 362/518
4,916,585 A 4/1990 Nino
4,994,947 A * 2/1991 Fesko ..... 362/297
5,067,053 A * 11/1991 Akizuki ..... 362/518
5,079,677 A * 1/1992 Kumagai ..... 362/522
5,692,824 A * 12/1997 Ooishi ..... 362/505
5,755,503 A * 5/1998 Chen et al. ..... 353/38
5,931,574 A 8/1999 Uchida
5,980,067 A * 11/1999 Albou et al. ..... 362/303
6,007,223 A * 12/1999 Futami ..... 362/517
6,045,245 A * 4/2000 Kanou ..... 362/518
6,109,772 A * 8/2000 Futami et al. ..... 362/517
6,244,731 B1 * 6/2001 Koiko et al. ..... 362/297
6,280,064 B1 * 8/2001 Sato et al. ..... 362/348
6,474,845 B1 * 11/2002 Mabe et al. ..... 362/296.04
6,543,921 B2 * 4/2003 Natsume ..... 362/518
6,543,923 B2 * 4/2003 Tamai ..... 362/521
6,739,743 B2 * 5/2004 Koshiro et al. ..... 362/520
6,746,634 B2 * 6/2004 Shimakura ..... 264/1.9
6,755,556 B2 * 6/2004 Gasquet et al. ..... 362/329
6,781,759 B1 * 8/2004 Wakita et al. ..... 359/599
2001/0003506 A1 6/2001 Natsume
2002/0145882 A1 * 10/2002 Shimakura ..... 362/518
2008/0316761 A1 * 12/2008 Minano et al. ..... 362/518

FOREIGN PATENT DOCUMENTS

DE 19919704 A1 12/1999

(Continued)

*Primary Examiner* — Hargobind S Sawhney
(74) *Attorney, Agent, or Firm* — Jacox, Meckstroth & Jenkins

(57) ABSTRACT

A light source or signaling module for the emission of an illuminating or signaling beam along a main direction, of the type including a light source, a luminous flux recovery mirror made up of a set of reflecting tiles, each reflecting tile being formed of a conical segment with two focal points, the first of which is located on the light source and a second focal point which is located, with respect to the reflecting tile, in a direction parallel to the main direction, each reflecting tile forming an image of the light source. The parameters of the conical segments with two focal points made up of the reflecting tiles are adjusted to confer upon the second focal points pre-determined photometric characteristics, and the images from the light source are directly visible.

31 Claims, 10 Drawing Sheets

FOREIGN PATENT DOCUMENTS

| | | | |
|---|---|---|---|
| EP | 0678703 | A1 | 10/1995 |
| EP | 0879989 | | 11/1998 |
| EP | 1947382 | | 7/2008 |
| FR | 2627256 | A1 | 8/1989 |
| FR | 2802284 | A1 | 6/2001 |
| GB | 2040431 | | 8/1980 |
| GB | 2280739 | | 2/1995 |
| GB | 2306637 | | 5/1997 |

* cited by examiner

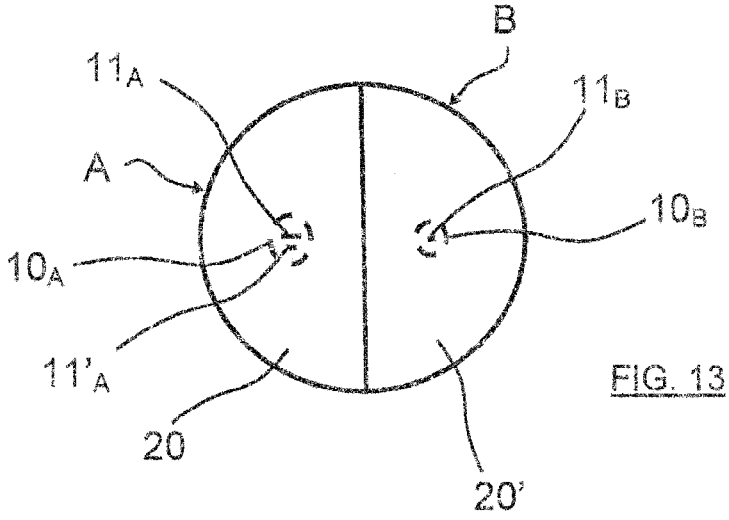
FIG. 13
FIG. 14
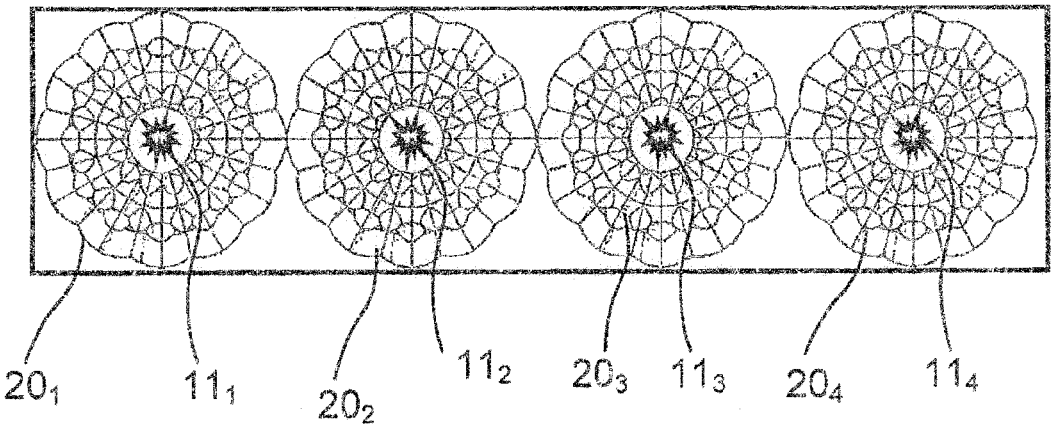

LIGHT MODULE FOR SIGNALING

BACKGROUND OF THE INVENTION

1. Field of the Invention

The invention described herein concerns a light source or signaling module, in particular as used for an automobile vehicle, offering improved appearance when lit.

The invention can be applied in particular to the field of motor vehicles, such as two-wheel motor vehicles, passenger cars, lightweight utility vehicles or heavyweight vehicles.

2. Description of the Related Art

Document FR 2 627 256 concerns a signaling lamp consisting primarily of a lamp equipped with a filament, a rear reflector and a transparent deflection component placed in front of the lamp. The rear reflector, in conjunction with the real light source, is designed to create, along a primarily vertical line and, perpendicular to the general direction of emission or optical X-X axis, multiple light sources, referred to as virtual in this document, distributed at equal distances along this line. To that effect, the rear reflector is subdivided into a range of sections that appear in the shape of ellipsoids, where the first focal point is located on the filament and where the second focal point is located where the virtual sources are found. The transparent deflection component, set in front of the sources, has a vertical and essentially constant section, which is associated with a focal point and designed to vertically deviate light rays from the focal point so that they can spread essentially parallel to a horizontal plane, the plane being achieved by shifting the section in such a manner that the focal point essentially follows the line of the sources.

The purpose of this layout is to form a signaling lamp that is wide in its breadth, as compared to its height, such as, for instance, a third raised-center stopping lamp in a raised central position. The deflection component placed in front of the light sources is designed to act on the elevation of rays diverging from a number of light sources, to bring it back to a value near zero, while leaving the azimuth angle practically unchanged.

Moreover, the reflector is designed so that each virtual source can emit light rays forward, essentially along the same angular range, on a median horizontal plane, such that the lamp's entire illuminating range maintains a homogenous appearance, whatever the point from which it is observed in the angular range.

Consequently, the lamp described in this document presents a homogeneously-lit range, in which there is no longer any distinction between the light sources and with which no specific aesthetic effects can be achieved.

Moreover, document EP 0 678 703 concerns a lamp intended for vehicles, which includes a light source combined with a reflector, the lamp having been designed to produce the effect of a range of isolated or essentially isolated light sources. According to this document, the reflector includes a variety of lenticular reflective elements, each of which is equipped with a convex or concave reflecting surface, spread in a fundamentally uniform manner across the surface of the reflector. The reflecting components are set in lines, horizontally or vertically parallel, or radial with respect to the lamp's longitudinal axis, or they occupy pre-determined circular sectors on circumferences or segments of circumferences that are concentric with respect to the lamp.

The reflecting components described in this document are curved, convex or concave in surface and their radius of curvature, directed horizontally or vertically, are chosen independently from one another, depending on the desired illuminating effect. The reflecting components are, as a result, visible through a smooth enclosing glass, like multiple light images.

Such a design allows little freedom for designing reflecting components, such that no specific aesthetic or stylistic effects can be achieved. The document provides only for matrix-based or circular arrangements for the reflecting components. In addition, as the reflecting components forming the multiple images achieved remain localized at the reflector, such that an observer outside the signaling beam' axis of emission will see only part of the multiple images. Furthermore, in order to comply with the photometric grids required by the regulations, the rows of reflecting components that form the reflector must be oriented in pre-determined directions, thus creating shadow zones in a frontal view of the lamp.

SUMMARY OF THE INVENTION

The invention evolved within this context and is aimed at remedying the drawbacks of the techniques set out previously, by proposing a light source or signaling module made up of a main light source, but which, once lit, would appear as a module with multiple visible light sources, the intensity of each of the visible sources being adjustable to any pre-determined value, and the position of each of the visible sources also being freely adjustable, so as to be able to form pre-determined patterns, provided that the visible sources can be seen from relatively large observation angles, and the luminous flux from all of the visible sources complying with regulations pertaining to the illuminating or signaling function provided by this light source or signaling module.

In this respect, the invention described herein proposes a light source or signaling module for the emission of an illuminating or signaling beam in one main direction, which would include a single light source, a mirror recovering luminous flux made of a set of reflecting tiles, and each reflecting tile is made up of a conical segment with two focal points, the first is located on the light source and the second focal point is located, with respect to the reflecting tile, in a specific direction with regards to the main direction, each reflecting tile forming an image of the light source.

In this invention, the parameters of the conical segments with two focal points made up of the reflecting tiles are adjusted to confer upon the second focal points a set of pre-determined photometric characteristics, and the images from the light source are directly visible.

According to the invention's other characteristics:

the conical segments with two focal points made up of the reflecting tiles are segments of ellipsoids of revolution, with the second focal points being located in front of the reflecting tile;

the conical segments with two focal points made up of the reflecting tiles are segments of hyperboloids of revolution, with the second focal points being located behind the reflecting tile;

the second focal points are located, with respect to the reflecting tile, in a direction practically parallel to the main direction;

the second focal points are located, with respect to the reflecting tile, on an incline relative to the main direction;

the pre-determined photometric characteristics for the second focal points belong to the group that includes the solid angle in which the light rays diverge from the second focal points and the direction in which the light rays diverge from the second focal points;

the parameters of the conical segments with two focal points made up of the reflecting tiles belong to the group that includes the solid angle, which originates from the light source and are based upon the contour of the reflecting tiles, as well as the parameters of the equations determining the conical segments with two focal points;

the images from the light source are located along the same plane, perpendicular to the main direction of the illuminating or signaling beam;

the module also includes an enclosing glass;

the enclosing glass is smooth or low-deviation;

the enclosing glass includes at least one deflection component;

the deflection component is located in the specific direction relative to a reflecting tile;

the deflection component is a dioptric component;

the dioptric component is a converging component in that it is focused clearly on the image formed by a reflecting tile;

the deflection component is a light-diffusing component;

the light source is made up of a filament from an incandescent lamp;

the light source is made of an electroluminescent diode;

an optical device is positioned in front of the light source;

the optical device acts as a light shutter;

the optical device is a reflector that reflects forward the light rays that hit it.

The invention also includes an illuminating or signaling device, featuring at least two illuminating or signaling components.

BRIEF DESCRIPTION OF THE DRAWINGS

Other objectives, characteristics and benefits of the invention described herein will clearly emerge from the description that will now be made of a sample product presented on a non-limiting basis in reference to the drawings annexed hereto, in which:

FIG. 13 schematically represents a first illuminating or signaling device in which two modules built according to the information derived from the present invention are implemented;

FIG. 14 schematically represents a second illuminating or signaling device in which several modules built according to the information derived from the present invention are implemented;

DESCRIPTION OF THE PREFERRED EMBODIMENTS

Figure 1:
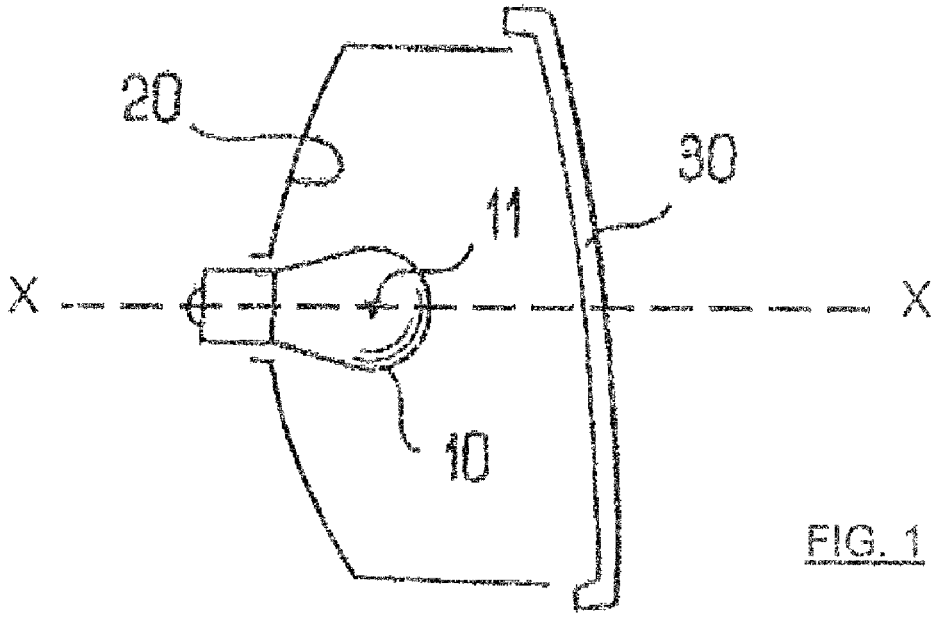
FIG. 1 schematically represents an axial vertical cross-section of a signaling module assembled according to the information derived from the present invention.

As a rule, in the description herein, the term "front" shall refer to the direction in which the emerging beam of light, for illuminating or signaling, is emitted, and "rear" shall refer to the opposite direction. In FIG. 1, for example, the front is seen on the right-hand side of the FIG. 1 and the rear to the left.

Figure 2:
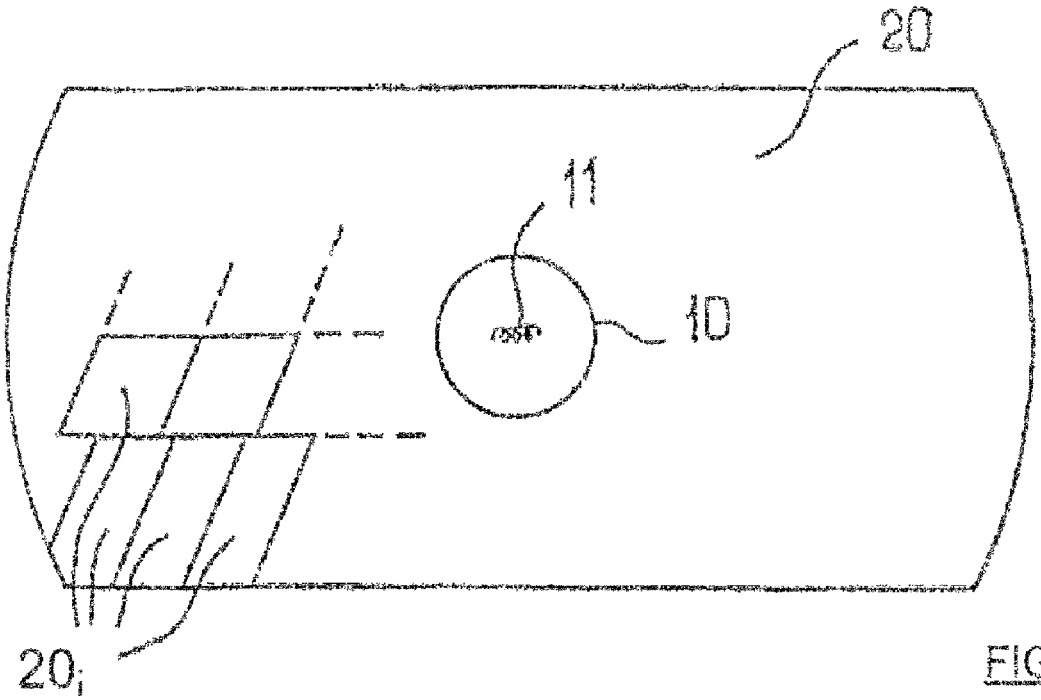
FIG. 2 schematically represents a front view of the signaling module in FIG. 1.

Referring first to FIGS. 1 and 2, a schematic representation of an automobile vehicle signaling lamp is illustrated, consisting of a light source or filament 11, mirror 20 recovering luminous flux and enclosing-glass 30, to emit the illuminating or signaling beam in accordance with main direction X-X. Light source 11 can be comprised, as depicted in FIGS. 1 to 3, of filament 11 of an incandescent lamp 10, or by an electroluminescent diode.

Under the first embodiment, enclosing-glass 30 is essentially smooth, meaning that it does not contain any optical components which would significantly affect the pathway of the light rays that cross through it.

As depicted in FIGS. 2 and 14, mirror 20 is made up of a series of reflecting tiles $\mathbf{20}_1$, $\mathbf{20}_2$ . . . $\mathbf{20}_i$, $\mathbf{20}_j$, which may or may not be contiguous. Each reflecting tile $\mathbf{20}_i$, and $\mathbf{20}_j$ is made up of a conical segment with two focal points, the first focal point being located on filament 11.

Figure 3:
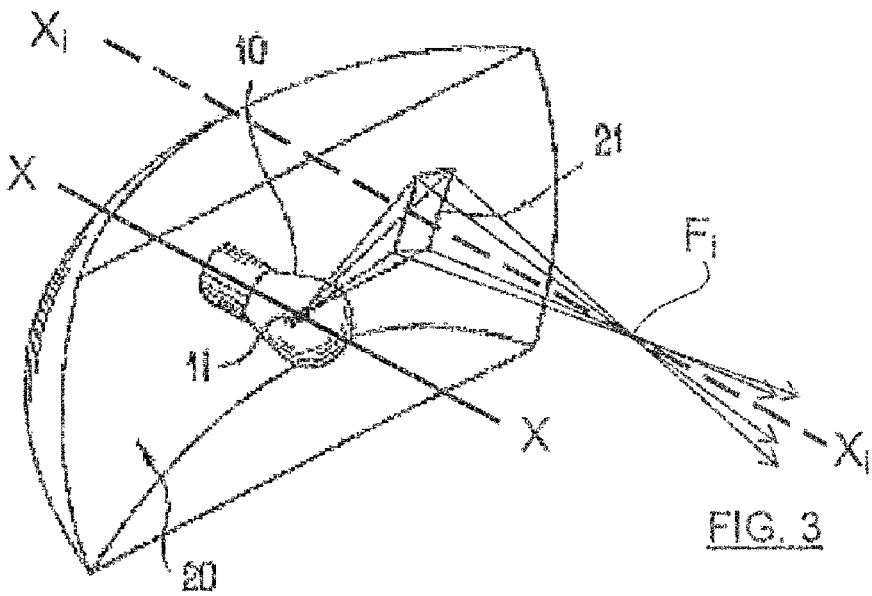
FIG. 3 schematically represents a perspective view of the signaling module in FIGS. 1 and 2, illustrating the pathway of the light rays emitted by the source.
Figure 4:
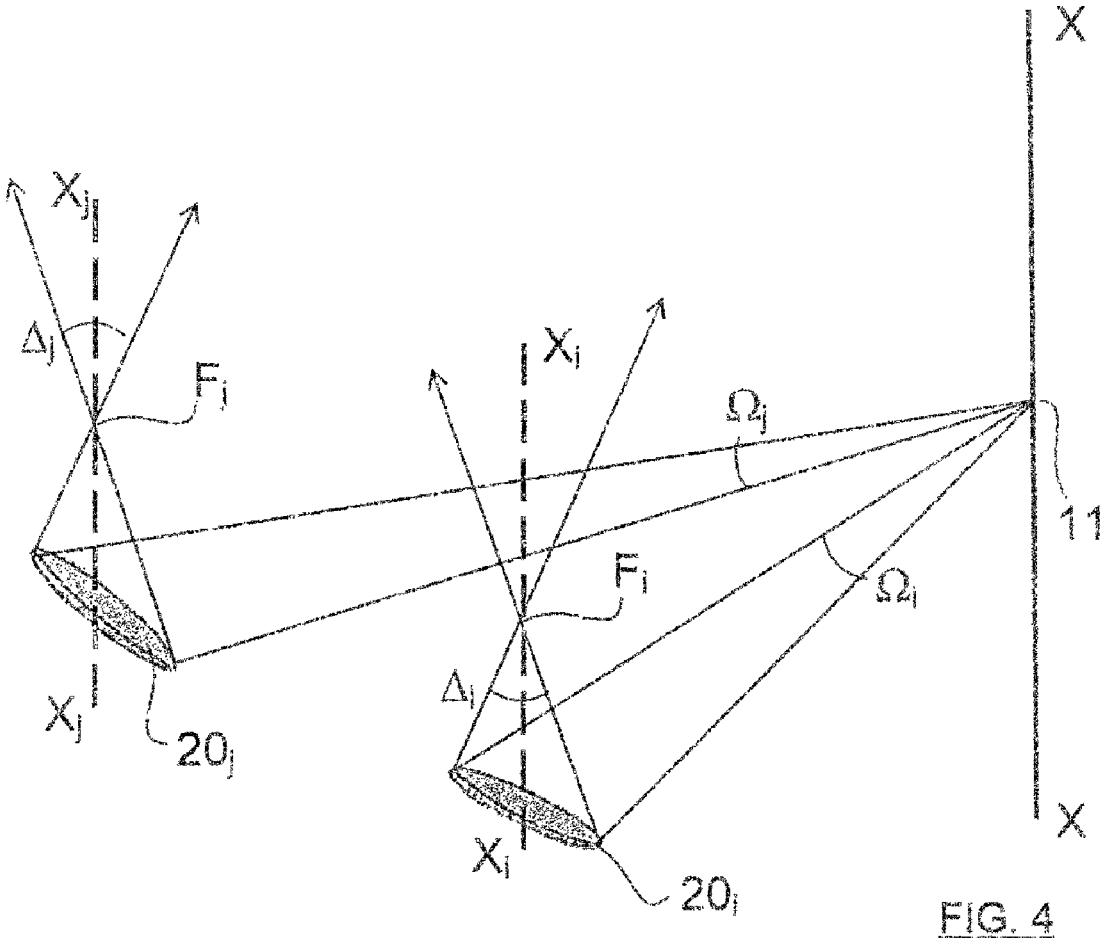
FIG. 4 schematically represents the pathway of the light rays reflected by a number of reflecting tiles in the signaling module.

In the embodiment illustrated in FIGS. 3 and 4, each reflecting tile $\mathbf{20}_i$, $\mathbf{20}_j$ is made up of an ellipsoid segment, in which the second focal point, $F_i$, $F_j$ is located in front of reflecting tile $\mathbf{20}_i$, $\mathbf{20}_j$, in a specific direction $X_i$-$X_i$, $X_j$-$X_j$).

Figure 15:
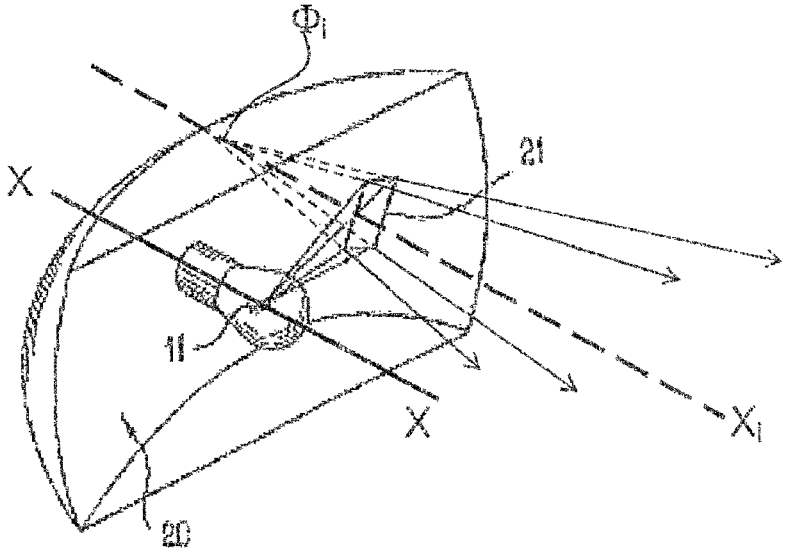
FIG. 15 schematically represents a view comparable to that in FIG. 3, with a variation on how the module's reflecting tiles are set up.
Figure 16:
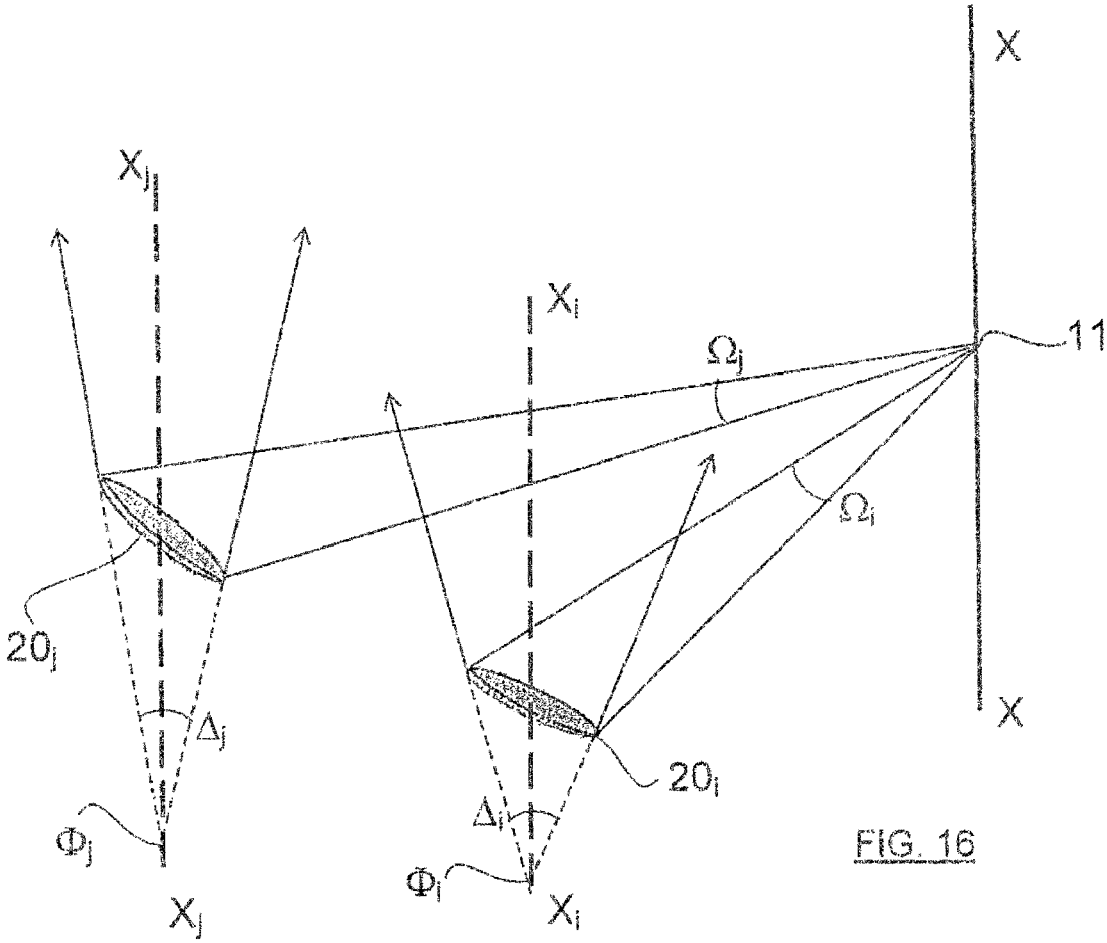
FIG. 16 schematically represents a view comparable to that in FIG. 4, with a variation on how the module's reflecting tiles are set up.

In the embodiment illustrated in FIGS. 15 and 16, each reflecting tile $\mathbf{20}_i$, and $\mathbf{20}_j$ is made up of a segment of the hyperboloid, wherein the second focal point $\Phi_i$, $\Phi_j$ is located behind reflecting tile $\mathbf{20}_i$, $\mathbf{20}_j$, in a specific direction $X_i$-$X_i$, $X_j$-$X_j$.

Direction $X_i$-$X_i$, $X_j$-$X_j$ can be parallel to the main direction X-X crossing through the center of reflecting tile $\mathbf{20}_i$, $\mathbf{20}_j$, as depicted in FIGS. 3 and 4. It can also be set on an incline along the same X-X axis. The latter may arise when light rays are to be emitted in specific directions, for instance, to comply with a regulatory photometric grid, or to avoid an obstacle that may be found on the pathway of the light rays, such as an internal wall of the illuminating of signaling device, in which the invention's module is installed.

In the embodiment illustrated in FIGS. 3 and 4, each second focal point $F_i$, $F_j$ forms a real image of filament 11. In the embodiment illustrated in FIGS. 15 and 16, each second focal point $\Phi_i$, $\Phi_j$ forms a virtual image of filament 11.

The second focal points $F_i$, $F_j$ or $\Phi_i$, $\Phi_j$ can be located along the same plane, perpendicular to the main X-X axis , or they may be spread freely, depending on the appearance that is to be given to the lit module. The spatial layout of second focal planes $F_i$, $F_j$ or $\Phi_i$, $\Phi_j$ with respect to enclosing-glass 30, when they are not co-planar, also gives an impression of depth and contours to the module when it is lit.

It can thus easily be understood that, when lamp 10 is lit, meaning when filament 11 is incandescent, each reflecting tile $\mathbf{20}_i$, $\mathbf{20}_j$ forms a real ($F_i$, $F_j$) or virtual ($\Phi_i$, $\Phi_j$) image, visible through enclosing-glass 30, which is smooth or with low-deviation.

Figure 18:
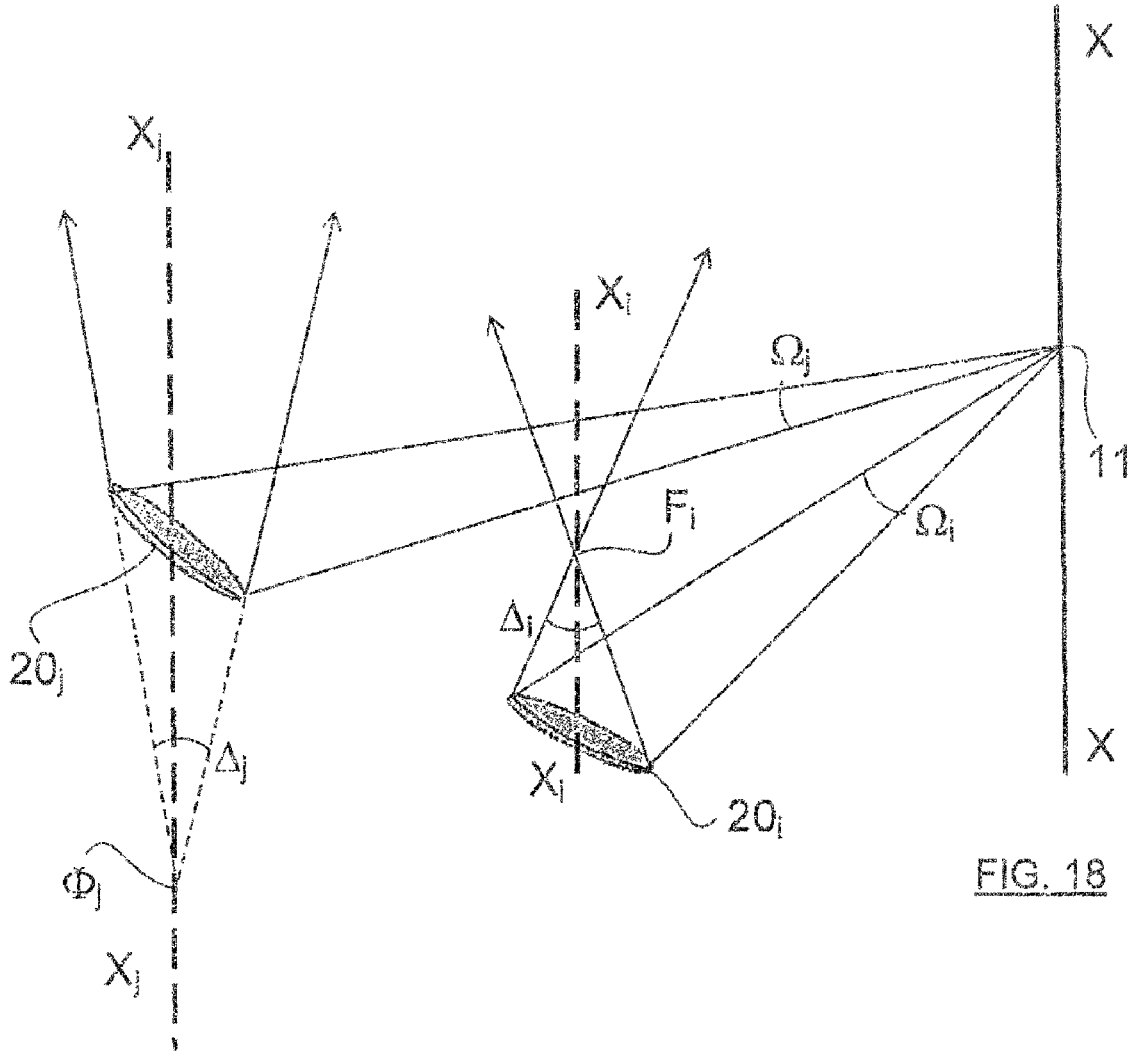
FIG. 18 schematically represents a combination of the production modules used in FIGS. 4 and 16.

As depicted in FIG. 18, it is also possible to combine the embodiments of FIGS. 3 or 4 and 15 or 16, signifying that mirror 20 would be made up of reflecting tiles $\mathbf{20}_i$, $\mathbf{20}_j$, some of which are ellipsoid segments with second focal points $F_i$, $F_j$ located in front of mirror 20 and some of which are hyperboloid segments with second focal points $\Phi_i$, $\Phi_j$ located behind mirror 20. Such an embodiment would allow even more flexibility in the design of mirror 20, determined by the appearance sought for the module when it is lit.

Figure 5:
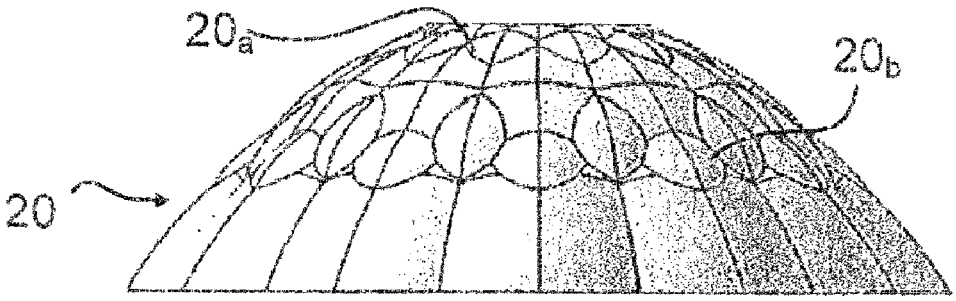
FIG. 5 schematically represents a side view of the rear of a reflector that can be used in the invention module.
Figure 6:
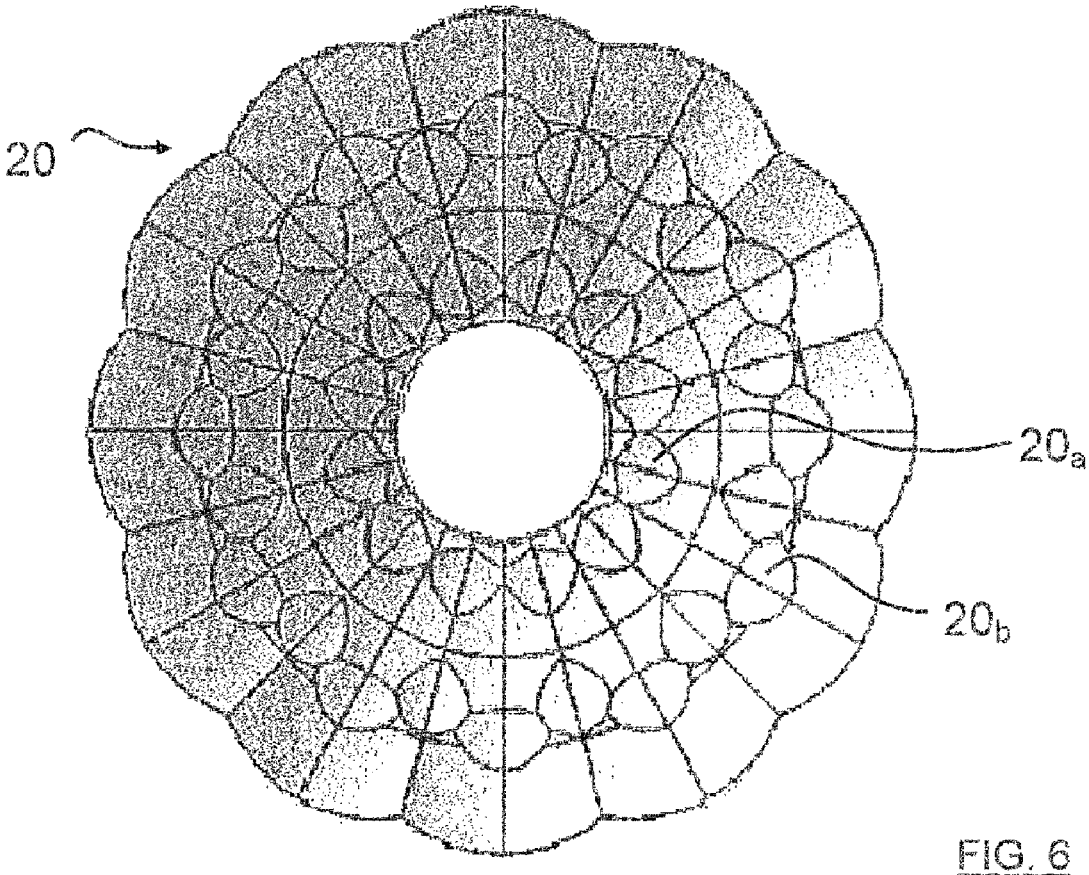
FIG. 6 schematically represents a front view of the reflector in FIG. 5.
Figure 9:
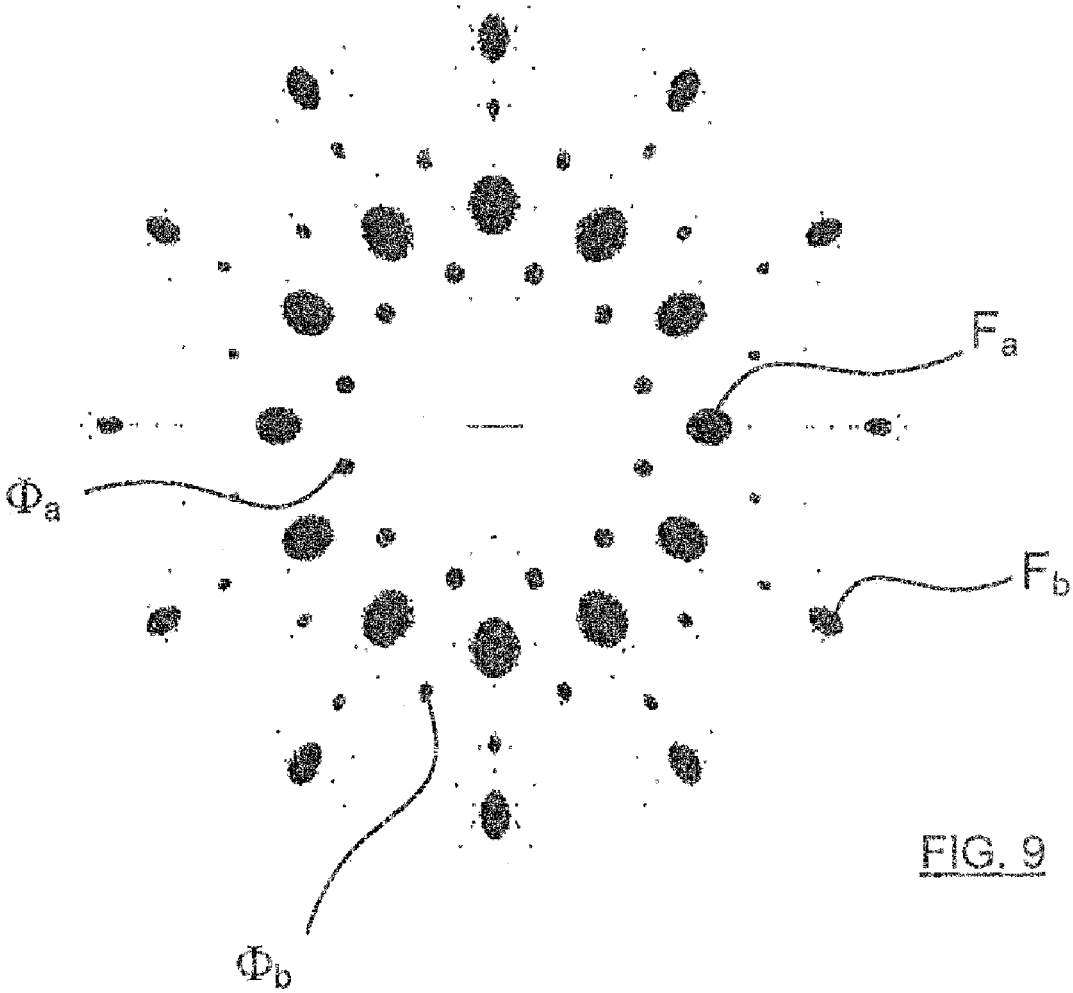
FIG. 9 schematically represents the light beam emitted by the invention's signaling module, equipped with the reflector in FIGS. 5 and 6.

In this manner, on mirror 20, there can be as many reflecting tiles $\mathbf{20}_i$, $\mathbf{20}_j$ as desired, depending on the effect that is sought for the module when lit. One example can be found in reflecting tiles $\mathbf{20}_a$, $\mathbf{20}_b$ on mirror 20, as depicted in FIGS. 5 and 6. The tiles are formed on concentric circles, in such a way that their centers are at a regular distance from one another, along the circles. As a result, real images $F_a$, $F_b$ and/or virtual images $\Phi_a$, $\Phi_b$ of filament 11 will also be spread regularly across concentric circles, as can be seen in FIG. 9, if the real images are located along axes $X_i$-$X_i$, $X_j$-$X_j$ parallel to main direction X-X. Real images $F_a$, $F_b$ and/or virtual images $\Phi_a$, $\Phi_b$ may also be spread out according to any other layout, without any requirement for symmetry, by choosing inclines appropriate to axes $X_i$-$X_i$, $X_j$-$X_j$ with respect to axis X-X.

Moreover, reflecting tiles $\mathbf{20}_a$, $\mathbf{20}_b$ may also be designed to pre-determine the intensity of real image $F_a$, $F_b$ and or virtual image $\Phi_a$, $\Phi_b$ Consequently, as depicted in FIGS. 4 and 16, assuming that filament 11 is a one-time light source, the filament "sees" each reflecting tile $\mathbf{20}_i$, $\mathbf{20}_j$ from a different solid angle $\Omega_i$, $\Omega_j$. Thus, by choosing the dimension of each reflecting tile $\mathbf{20}_i$, $\mathbf{20}_j$, it will be possible to determine the amount of light reflected by each tile and that reaches each real image $F_i$, $F_j$ or appearing to come from each virtual image $\Omega_i$, $\Omega_j$.

Figure 7:
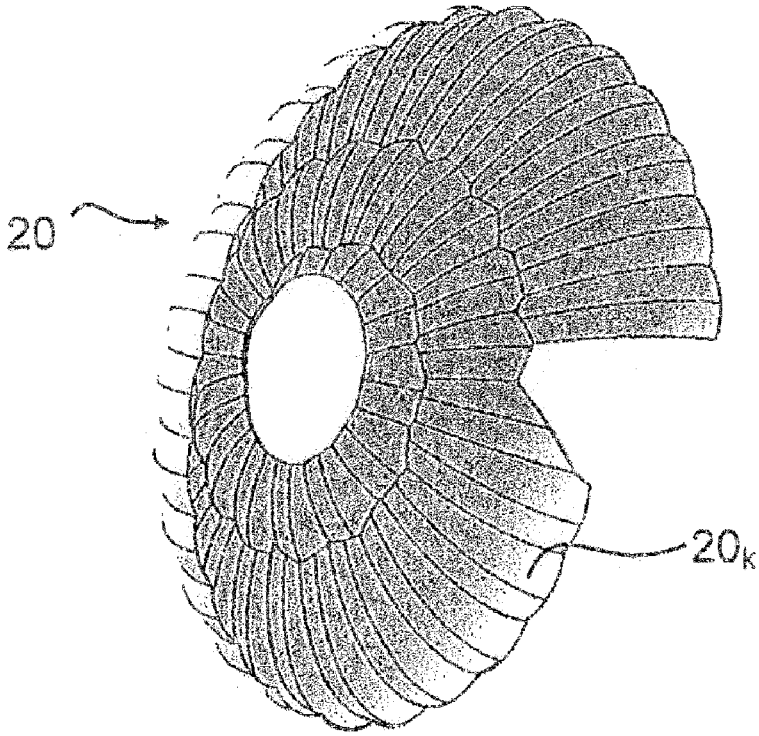
FIG. 7 schematically represents a perspective view of another reflector that can be used in the invention module.
Figure 8:
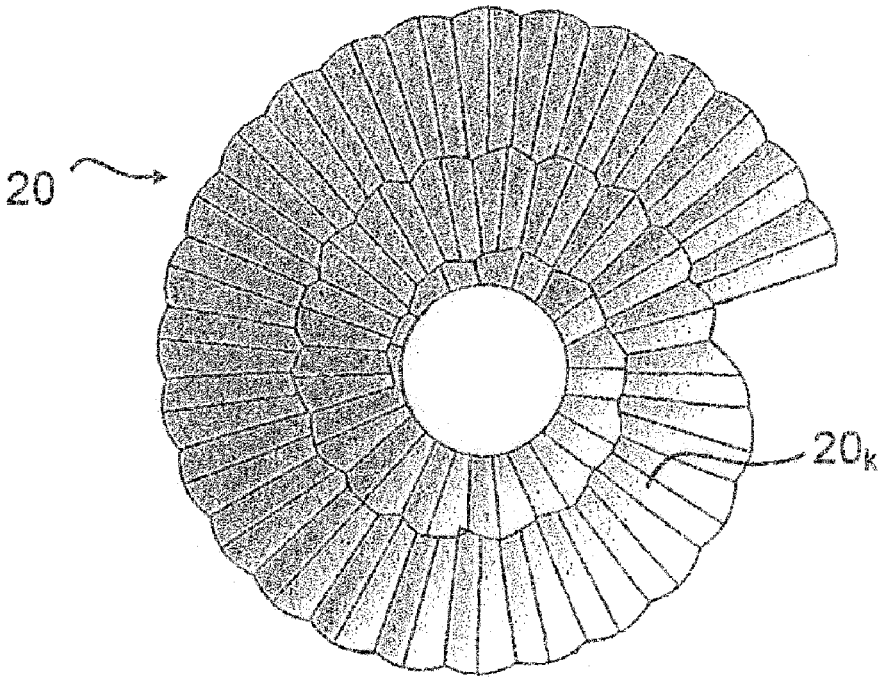
FIG. 8 schematically represents a front view of the reflector in FIG. 7.
Figure 10:
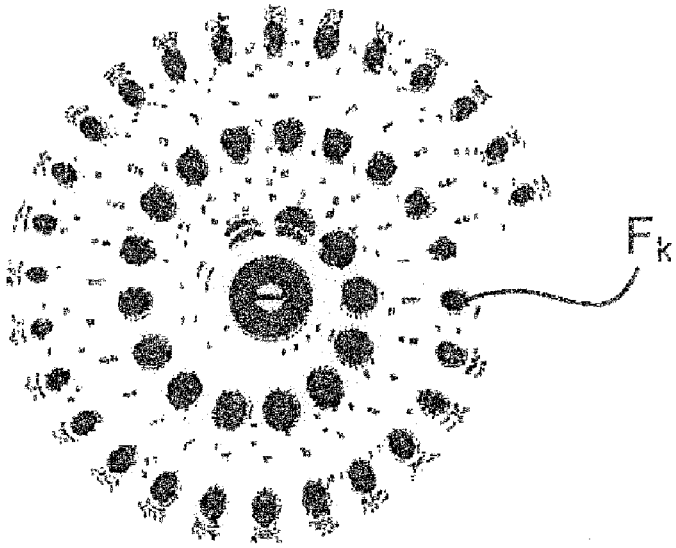
FIG. 10 schematically represents the light beam emitted by the invention's signaling module, equipped with the reflector in FIGS. 7 and 8.

Likewise, for example, reflecting tile $\mathbf{20}_k$ may be arranged along mirror 20 as depicted in FIGS. 7 and 8, spread regularly along a spiral. The result is that real image $F_k$ or virtual image $\Phi_k$ on filament 11 will also be spread evenly along the spiral, as illustrated in FIG. 10. In order to enable images $F_k$ or $\Phi_k$ to have similar intensity levels, reflecting tile $\mathbf{20}_k$ can be given ascending sizes, according to their distance from filament 11, as depicted in FIGS. 7 and 8.

FIG. 4 illustrates that, depending on solid angle $\Delta_i$ under which reflecting tiles $\mathbf{20}_i$ will concentrate light received from filament 11 on the real image associated with $F_i$, the light rays will diverge from image $F_i$ under the same solid angle $\Delta_i$. The result is that image $F_i$ will be perfectly visible to an observer found in solid angle $\Delta_i$ located in the average direction X-$X_i$.

Likewise, FIG. 16 shows that, according to the parameters of the hyperboloid surfaces that form reflecting tiles $\mathbf{20}_i$, the light rays will diverge from virtual image $\Phi_i$ at a solid angle $\Delta_i$, making image $\Phi_i$ visible to an observer found in the solid angle $\Delta_i$ located in the average direction X-$X_i$.

Moreover, it is commonly known that an ellipsoid is a surface defined according to an orthonormal reference point appropriately chosen by the general equation:

$$\frac{x^2}{a^2}+\frac{y^2}{b^2}+\frac{z^2}{c^2}=1$$

where a, b and c are strictly positive set parameters, equal to the lengths of the ellipsoid semi-axes.

Likewise, it is commonly known that a hyperboloid is a surface defined according to an orthonormal reference point appropriately chosen by the general equation:

$$\frac{x^2}{\alpha^2}+\frac{y^2}{\beta^2}-\frac{z^2}{\gamma^2}=1$$

where $\alpha$, $\beta$ and $\gamma$ are strictly positive set parameters, equal to the lengths of the hyperboloid semi-axes.

In this instance, the position of both focal points for each ellipsoid or each hyperboloid is a given: the first focal point lies on filament 11 of lamp 10, and the second focal points $F_i$ or $\Phi_i$ are positioned at the points where the real or virtual images of filament 11 are to be placed, meaning on axes $X_i$-$X_i$, which may or may not be parallel to axis X-X. The origin of the orthonormal reference point is located in the middle of the segment connecting both focal points, one of the axes crosses through both focal points and the other two axes are perpendicular to the first axis and perpendicular to each other.

By appropriately choosing parameters a, b and c or $\alpha$, $\beta$ and $\gamma$ as recalled above, there will be the option, for instance, of choosing how to direct the light beam reflected by each reflecting tile $\mathbf{20}_i$. This means that each reflecting tile may be designed so as to send out light rays in pre-determined directions, whether to increase the visibility of the light source or signaling module or to comply with a regulatory photometric grid.

The choice between parameters a, b and c or $\alpha$, $\beta$ and $\gamma$ will, of course, be combined with the choice of how to set solid angle $\Delta_i$ in which the light rays diverge from $F_i$ or $\Phi_i$, in order to determine the amount of light to emit in a specific direction.

In particular, it will be possible to determine the value of solid angle $\Delta_i$, and thereby, the angle under which all images of $F_i$ or $\Phi_i$ will be visible. For example, it will be possible to produce reflecting tiles $\mathbf{20}_i$ in such a way that they remain fully visible to an observer located in a direction forming an angle of around 20 degrees, with respect to the main direction X-X.

Figure 11:
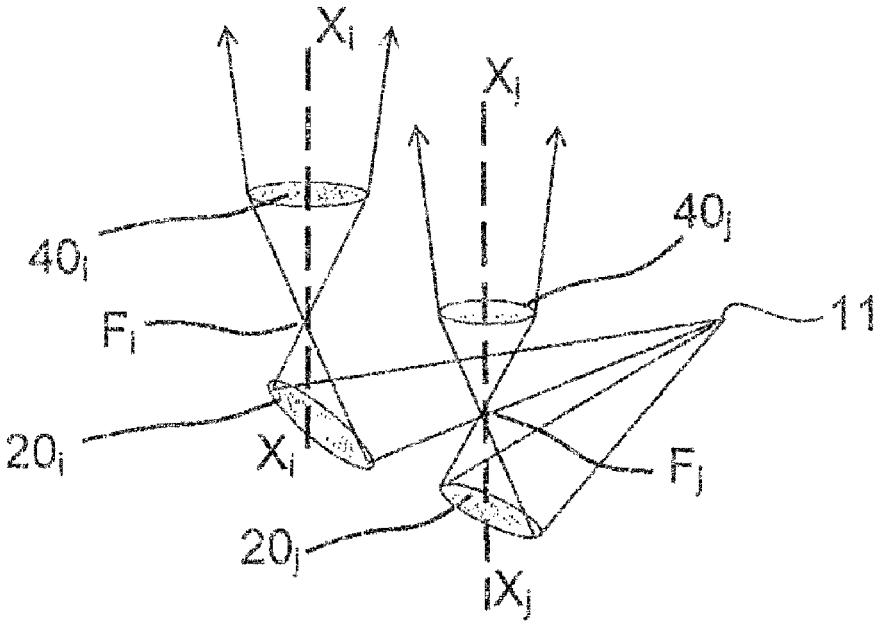
FIG. 11 schematically represents an alternative of the signaling module, according to the invention, seen in the pathway of the light rays reflected by a number of reflecting tiles on the signaling lamp.
Figure 12:
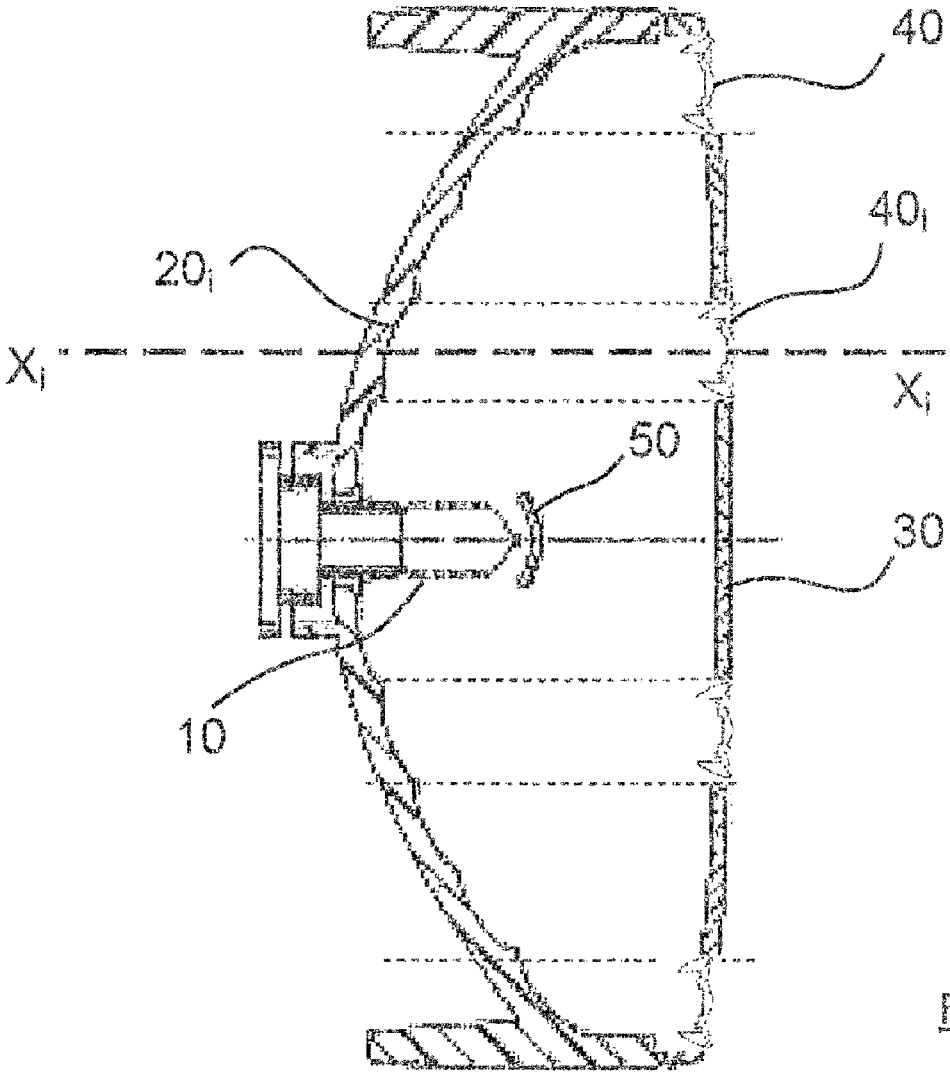
FIG. 12 schematically represents an axial vertical cross-section of a signaling module built according to the information derived from a second embodiment of the invention herein.
Figure 17:
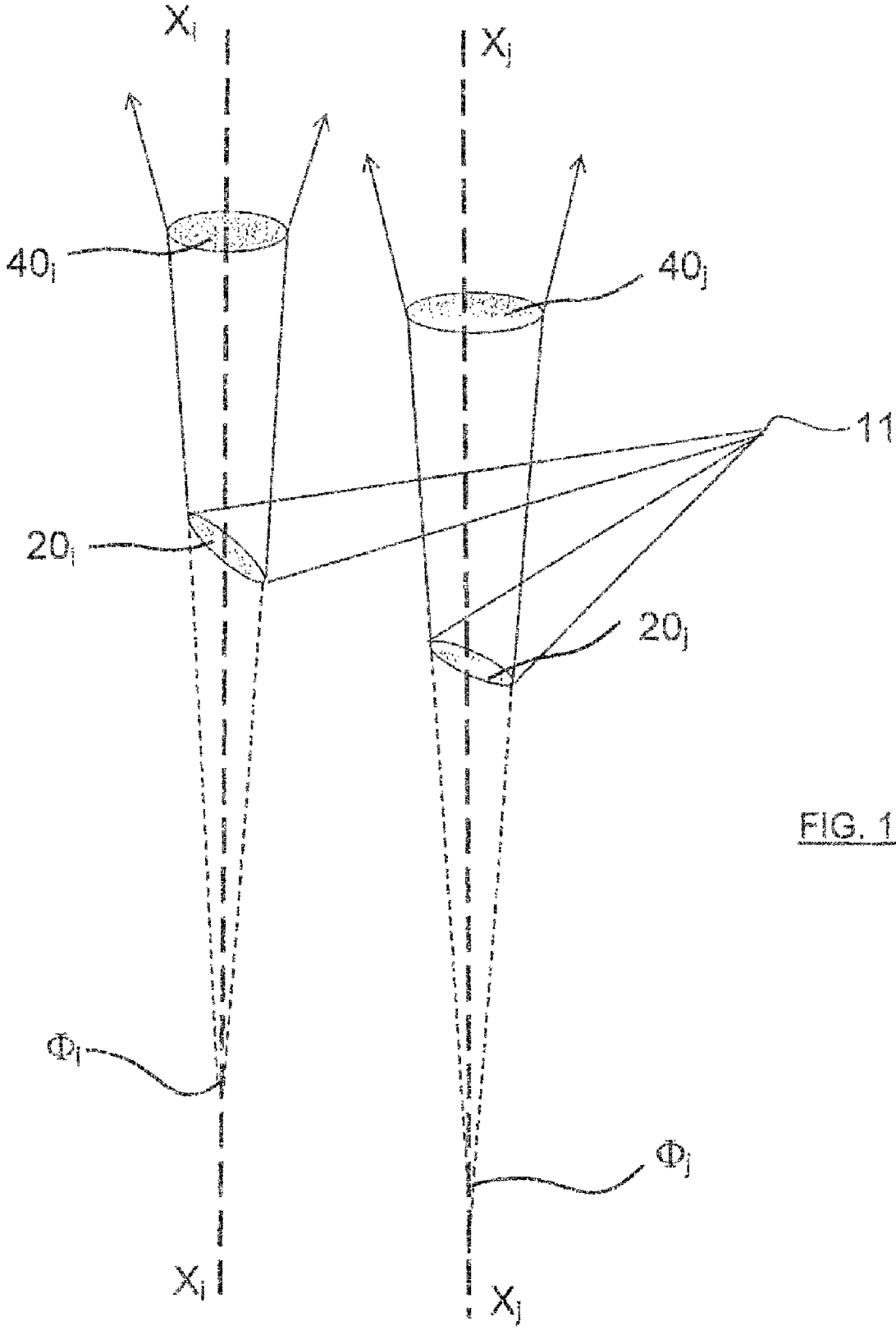
FIG. 17 schematically represents a view comparable to that in FIG. 11, with a variation on how the module's reflecting tiles are set up.

FIGS. 11, 12 and 17 schematically represent another embodiment for the invention described herein, in which enclosing-glass 30 includes deflection components 40. More precisely speaking, deflection components $\mathbf{40}_i$, $\mathbf{40}_j$ are arranged across from reflecting tiles $\mathbf{20}_i$, $\mathbf{20}_j$ on axes $X_i$-$X_i$, $X_j$-$X_j$, regardless of whether the axes are parallel to main axis X-X. They shall be made of dioptric, convergent or divergent components, and will be focused on real images $F_i$ or virtual images $\Phi_i$. As such, they will ultimately form light beams that can be practically parallel, convergent or divergent, to give a special appearance to the module and/or to achieve a pre-determined photometric profile.

Thus, enclosing-glass 30 may include both smooth zones through which real images $F_i$, $F_j$ and/or virtual images $\Phi_i$, $\Phi_j$ from light source 11 will be directly visible, and zones including deflection components 40, for instance dioptric components or diffusing components.

As a variation on the first and second embodiments described above, optical device 50 may be placed in front of light source 11, as depicted in FIG. 12. The optical device 50 may serve as a shutter intended to hide primary filament 11, in such a manner that the observer can see only the real or virtual images from the primary source. It may also be made up of a reflector, reflecting forward the light rays that reach it, for instance from other vehicles' illuminating devices, in such a away that the module in this invention, in addition to its function as an illuminating or signaling device, may also fulfill the function of a regulatory signaling system.

Thus, we have clearly produced a light source or signaling module consisting of a single light source, which when lit, appears as a module which includes multiple light sources. The position of each of the sources may be defined in such a way as to form a variety of geometric patterns, and the intensity of the sources may be adjusted to any pre-determined value. It has been illustrated herein that the above choices are possible without needing to use dioptric components, with lead to loss of light. Light yield for the invention's module is thus optimal. Furthermore, the ellipsoidal and/or hyperboloidal surfaces enable better recovery of the luminous flux emitted by the primary source as compared to dealing with paraboloidal surfaces. As the reflecting mirror is made of ellipsoidal and/or hyperboloidal segments, any discontinuity between the various segments is far less than that which would be generated by multifocal paraboloidal surfaces.

Consequently, the light source or signaling module described herein may be used alone as a means of fulfilling a regulatory illuminating or signaling requirement, such as rear lamp, stop lamp, direction change signal or reverse drive lamp. Likewise, illuminating or signaling devices may also be produced using a number of different modules.

Depicted in FIGS. 13 and 14 are such illuminating and signaling devices. FIG. 13 illustrates a device that offers the combined function of a position lamp and stop lamp. To this end, it uses two cavities—A and B—each corresponding to one of the modules as described previously. The cavities include mirrors 20 and 20' respectively, each including reflecting tiles $\mathbf{20}_i$, not illustrated here to avoid overcrowding the drawing. Examples of this would include the reflecting tiles in cavity A which work together with lamp $\mathbf{10}_A$ and filaments $\mathbf{11}_A$ and $\mathbf{11}_A$, in standard lamp P21/5 W, in the same way as the reflecting tiles in cavity B work together with lamp $\mathbf{10}_B$, with a single-filament $\mathbf{11}_B$ in standard lamp R5 W.

The position lamp function is fulfilled by the simultaneous illuminating of filaments $\mathbf{11'}_A$ and $\mathbf{11}_B$, which have the same 5-watt power and the stop light function is fulfilled by illuminating filament $\mathbf{11}_A$, with 21 watts of power. These two functions are fulfilled with the same benefits as those described in reference to the module alone.

Likewise, an elongated lamp with a signaling function can be formed by juxtaposing several modules, as depicted in FIG. 14, for instance, to produce a third, central raised stop lamp. In FIG. 14, the light sources used are electroluminescent diodes $\mathbf{11}_1$, $\mathbf{11}_2$, $\mathbf{11}_3$ and $\mathbf{11}_4$, and work together with reflecting tiles $\mathbf{20}_1$, $\mathbf{20}_2$, $\mathbf{20}_3$ and $\mathbf{20}_4$ from four reflectors in this example. This makes it possible to achieve a signaling function with an entirely new appearance.

Of course, the intention described herein is not only limited to the embodiments described, but a professional will, in contrast, be able to carry out the many modifications that fall within this scope.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A motor vehicle light module for emitting a beam along a main direction outside a motor vehicle after the motor vehicle light module is mounted on the motor vehicle, said motor vehicle light module comprising:

a light source for generating the beam;

a luminous flux recovery mirror made up of a set of reflecting tiles for reflecting light from said light source, each of said reflecting tiles being formed of a conical segment comprising a first focal point and a second focal point, said first focal point being focused on said light source and said second focal point being focused, with respect to said reflecting tile, in a specific direction in reference to said main direction, each of said reflecting tiles forming an image of said light source that is visible outside the vehicle, insofar as parameters of said conical segments with said first and second focal points containing said reflecting tiles are adjusted to confer upon said second focal points pre-determined photometric characteristics, and in that images of said light source are directly visible from outside the motor vehicle;

wherein a size of said plurality of said reflecting tiles increases as a distance from said light source increases so that images reflected from said plurality of said plurality of reflecting tiles all comprise generally similar intensities;

each of said reflecting tiles forming said images of said light source that are visible outside the motor vehicle with said images of said light source causing said motor vehicle light module to appear to have multiple visible light sources when viewed from outside the motor vehicle after the motor vehicle light module is mounted on the motor vehicle.

2. The motor vehicle light module as recited in claim 1, wherein said conical segments with two focal points made up of reflecting tiles are ellipsoid of revolution segments, and said second focal points are located in front of said reflecting tile.

3. The motor vehicle light module as recited in claim 1, wherein said conical segments with two focal points made up of reflecting tiles are hyperboloid of revolution segments, and said second focal points are located behind a reflecting point.

4. The motor vehicle light module as recited in claim 2, wherein said second focal points are placed in a direction with respect to said reflecting tile that is almost parallel to said main direction.

5. The motor vehicle light module as recited in claim 2, wherein said second focal points are located in a direction with respect to said reflecting tile on an incline with respect to said main direction.

6. The motor vehicle light module as recited in claim 1, wherein said motor vehicle light module comprises means for causing said light rays to diverge from said second focal point, said means comprising pre-determined photometric characteristics of said second focal points belong to a group with a solid angle in which light rays diverge from said second focal points, and a direction in which light rays diverge from said second focal points.

7. The motor vehicle light module as recited in claim 1, wherein said parameters of said conical segments with two focal points made up of reflecting tiles belong to a group with a solid angle originating from said light source and based on a contour of said reflecting tiles and said parameters determine said conical segments with said first and second focal points.

8. The motor vehicle light module as recited in claim 1, wherein said images from said light source are located along the same plane, perpendicular to said main direction for emission of an illuminating or signaling beam emission.

9. The motor vehicle light module as recited in claim 1, wherein said light source or signaling module also includes an enclosing glass.

10. The motor vehicle light module as recited in claim 9, wherein said enclosing glass is smooth or low-deviation.

11. The motor vehicle light module as recited in claim 9, wherein said enclosing glass includes at least one deflection component.

12. The motor vehicle light module as recited in claim 11, wherein said at least one deflection component is located in a specific direction with respect to a reflecting tile.

13. The motor vehicle light module as recited in claim 12, wherein said at least one deflection component is a diffusing component.

14. The motor vehicle light module as recited in claim 11, wherein said at least one deflection component is a dioptric component.

15. The motor vehicle light module as recited in claim 14, wherein said dioptric component is a convergent component, and in that it is essentially focused on a image formed by a reflecting tile.

16. The motor vehicle light module as recited in claim 1, wherein said light source is made up of a filament from an incandescent lamp.

17. The motor vehicle light module as recited in claim 1, wherein said light source is made up of an electroluminescent diode.

18. The motor vehicle light module as recited in claim 1, wherein an optical device is set in front of said light source.

19. The motor vehicle light module as recited in claim 18, wherein said optical device is a shutter.

20. The motor vehicle light module as recited in claim 18, wherein said optical device is a reflector reflecting forward light rays that hit it.

21. A device for motor vehicles, which includes a plurality of said motor vehicle light modules as recited in claim 1.

22. A motor vehicle lighting module, said motor vehicle lighting module comprising:

a luminous flux recovery mirror;

a light source for generating a beam along a main direction outside the motor vehicle;

said luminous flux recovery mirror comprising:

a body having a plurality of reflecting tiles, each of said plurality of reflecting tiles being formed of a conical segment having a first focal point which is located on said light source and a second focal point which is located with respect to said reflecting tile in a specific direction in reference to said main direction, each of said plurality of reflecting tiles being adjusted to confer upon said second focal points pre-determined photometric characteristics;

wherein a size of said plurality of said reflecting tiles increases as a distance from said light source increases so that images reflected from said plurality of said plurality of reflecting tiles all comprise generally similar intensities:

each of said reflecting tiles providing a reflected image of said light source so that said motor vehicle light module provides a plurality of images of said light source when said motor vehicle lighting module is viewed from outside the motor vehicle after the motor vehicle lighting module is mounted on the motor vehicle.

23. The motor vehicle lighting module as recited in claim 22, wherein each of said plurality of reflecting tiles forms an image of said light source that is visible.

24. The motor vehicle lighting module as recited in claim 22, wherein said conical segments are made up of reflecting tiles that are ellipsoid of revolution segments, and said second focal point is located in front of said reflecting tile.

25. The motor vehicle lighting module as recited in claim 22, wherein said conical segments are made up of reflecting tiles that are hyperboloid of revolution segments, and said second focal point is located behind a reflecting point.

26. The motor vehicle lighting module as recited in claim 22, wherein said second focal point is placed in a direction with respect to said reflecting tile that is almost parallel to said main direction.

27. The motor vehicle lighting module as recited in claim 22, wherein said second focal point is located in a direction with respect to said reflecting tile on an incline with respect to said main direction.

28. The motor vehicle lighting module as recited in claim 22, wherein said light source or signaling module also includes an enclosing glass.

29. The motor vehicle lighting module as recited in claim 28, wherein said enclosing glass is smooth or low-deviation.

30. The motor vehicle lighting module as recited in claim 28, wherein said enclosing glass includes at least one deflection component.

31. The motor vehicle lighting module as recited in claim 30, wherein said at least one deflection component is a dioptric component.

* * * * *

UNITED STATES PATENT AND TRADEMARK OFFICE

CERTIFICATE OF CORRECTION

PATENT NO. : 8,096,690 B2
APPLICATION NO. : 12/014377
DATED : January 17, 2012
INVENTOR(S) : Goncalves et al.

It is certified that error appears in the above-identified patent and that said Letters Patent is hereby corrected as shown below:

Column 4, line 66, "of" should be --or--. (2nd occurrence)

Column 7, line 25, "with" should be --which--.

Signed and Sealed this
Seventeenth Day of July, 2012

David J. Kappos
*Director of the United States Patent and Trademark Office*